US010365572B2

(12) United States Patent
Okuzono

(10) Patent No.: US 10,365,572 B2
(45) Date of Patent: Jul. 30, 2019

(54) IMAGE FORMING APPARATUS

(71) Applicant: TOSHIBA TEC KABUSHIKI KAISHA, Shinagawa-ku, Tokyo (JP)

(72) Inventor: Natsuko Okuzono, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/995,352

(22) Filed: Jun. 1, 2018

(65) Prior Publication Data

US 2019/0101841 A1 Apr. 4, 2019

(30) Foreign Application Priority Data

Oct. 2, 2017 (JP) ..... 2017-193089

(51) Int. Cl.
*G03G 21/00* (2006.01)
*G03G 9/09* (2006.01)
*G03G 15/00* (2006.01)

(52) U.S. Cl.
CPC ..... *G03G 9/0926* (2013.01); *G03G 15/5041* (2013.01); *G03G 2215/00037* (2013.01)

(58) Field of Classification Search
CPC ..... G03G 9/0926; G03G 15/5041; G03G 2215/00037
See application file for complete search history.

(56) References Cited

U.S. PATENT DOCUMENTS

| | | | | |
|---|---|---|---|---|
| 7,283,758 | B2 | 10/2007 | Murakami | |
| 7,567,767 | B2 | 7/2009 | Kikuchi | |
| 2010/0247193 | A1 | 9/2010 | Suzuki | |
| 2012/0170064 | A1 | 7/2012 | Hibino et al. | |
| 2013/0045020 | A1 | 2/2013 | Kaneko et al. | |
| 2015/0277305 | A1 | 10/2015 | Umetsu | |
| 2015/0378289 | A1* | 12/2015 | Kinouchi | G03G 15/6585 399/69 |
| 2016/0062298 | A1 | 3/2016 | Sato et al. | |
| 2018/0329349 | A1* | 11/2018 | Suzuki | G03G 15/2039 |

OTHER PUBLICATIONS

Search Report dated Mar. 29, 2019, received in corresponding European Application No. 18 19 7896.6, 6 pages.

* cited by examiner

*Primary Examiner* — David M. Gray
*Assistant Examiner* — Michael A Harrison
(74) *Attorney, Agent, or Firm* — Foley & Lardner LLP

(57) ABSTRACT

An image forming apparatus includes a printer and a controller. The printer transfers an image formed by attaching toner to an electrostatic latent image onto a sheet, heats and presses the sheet onto which the visible image is transferred to fix the image onto the sheet, and thereby forms an image on the sheet. The controller controls the printer to form an image for a second surface, and then to form an image for a first surface which differs from a surface on which the image for the second surface is formed, when the controller determines that duplex printing, in which decolorable toner is used on the first surface on which an image is first formed, and toner having a fixing temperature higher than a decolorizing temperature is used on the second surface, is set in printing job data.

16 Claims, 7 Drawing Sheets

IMAGE FORMING APPARATUS

CROSS-REFERENCE TO RELATED APPLICATION

This application is based upon and claims the benefit of priority from Japanese Patent Application No. 2017-193089, filed Oct. 2, 2017, the entire contents of which are incorporated herein by reference.

FIELD

The present disclosure relates generally to an image forming apparatus.

BACKGROUND

An image forming apparatus forms an image on a sheet. Hereinafter, forming an image on a sheet will also be referred to as "printing". In order to perform printing, the image forming apparatus forms an electrostatic latent image on a photoconductive drum on the basis of image information. The image forming apparatus attaches toner to the electrostatic latent image so as to form a visible image. The image forming apparatus transfers the formed visible image onto a sheet. The image forming apparatus heats and presses the sheet onto which the visible image is transferred, so as to fix the visible image to the sheet.

An image forming apparatus may perform duplex printing by fixing a visible image to one of a front surface and a rear surface of a sheet, and then fixing a visible image to the other surface. An image formed on a sheet by using decolorable toner is decolorized by heat of a predetermined temperature or higher. Thus, in duplex printing, if decolorable toner is used on a surface first printed, and another type of toner having a high fixing temperature is used on a surface printed next, an image first formed on the sheet by using the decolorable toner may be decolorized.

DETAILED DESCRIPTION

An object of some exemplary embodiments is to provide an image forming apparatus capable of preventing an image formed by using decolorable toner on one surface in duplex printing from being decolorized.

According to at least one exemplary embodiment, there is provided an image forming apparatus including a printer unit and a control unit. The printer unit transfers a visible image formed by attaching toner to an electrostatic latent image on a photoconductive drum onto a sheet, heats and presses the sheet onto which the visible image is transferred so as to fix the visible image onto the sheet, and thus forms an image on the sheet. The control unit controls the printer unit to form an image for a second surface on a sheet, and then to form an image for a first surface on a surface which is different from a surface on which the image for the second surface is formed, if the control unit determines that duplex printing in which decolorable toner is used on the first surface which is a surface on which an image is first formed of a front surface and a rear surface of a sheet, and toner having a fixing temperature higher than a decolorizing temperature of the decolorable toner is used on the second surface which is a surface on which an image is formed after the first surface, is set in job data for giving an instruction for image formation.

Hereinafter, with reference to the drawings, a description will be made of an image forming apparatus of at least one exemplary embodiment.

Figure 1:
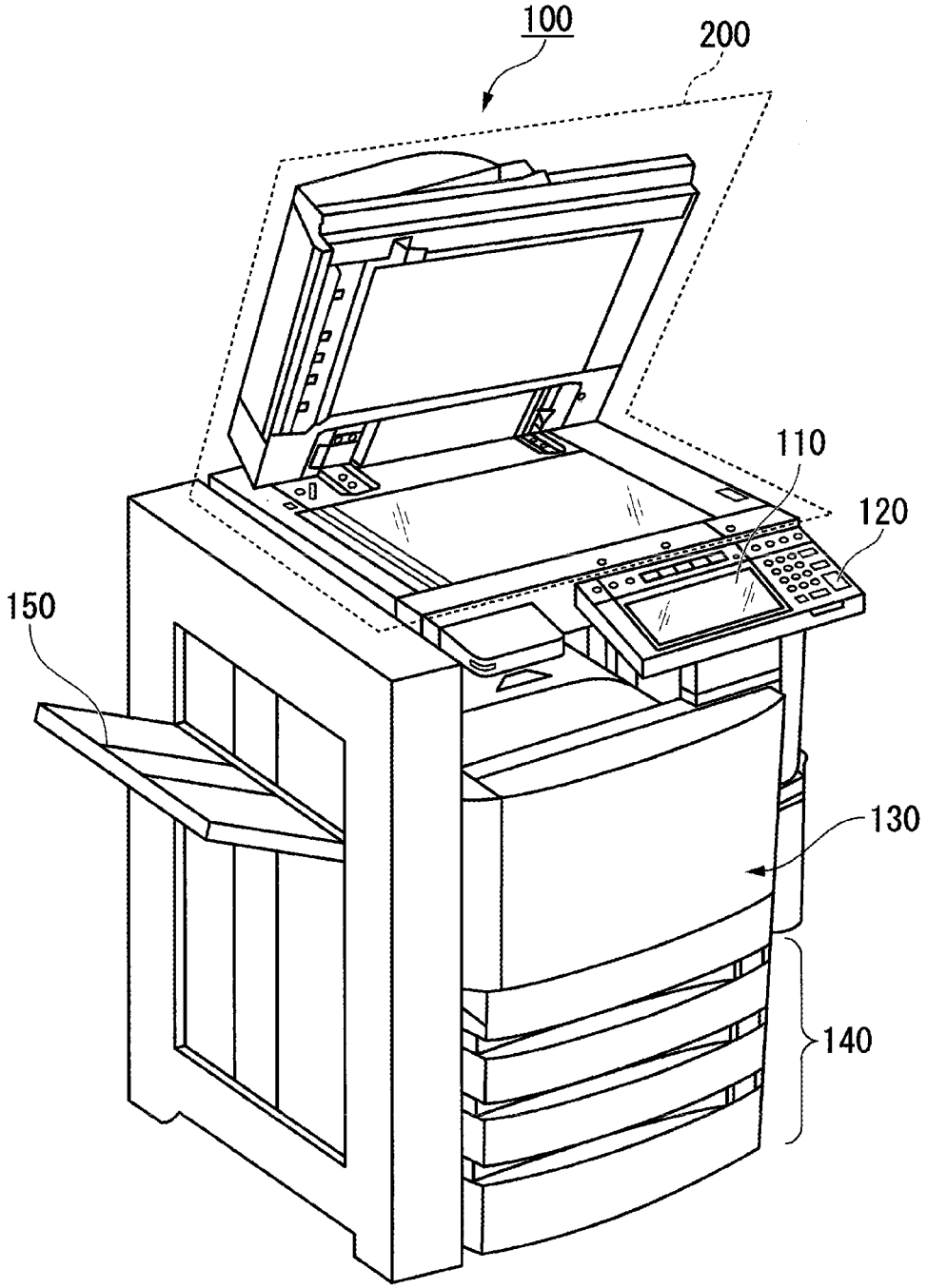
FIG. 1 is an exterior view illustrating a configuration example of an image forming apparatus of at least one exemplary embodiment.

FIG. 1 is an exterior view illustrating a configuration example of an image forming apparatus 100 of at least one exemplary embodiment. The image forming apparatus 100 is, for example, a multi-function peripheral. The image forming apparatus 100 includes a display 110, a control panel 120, a printer 130, a sheet accommodation section (a sheet storage or sheet housing) 140, a finisher 150, and an image reading section (an image reader) 200.

The image forming apparatus 100 forms an image on a sheet by using a developing agent such as toner. The toner includes non-decolorable toner which is not decolorable and decolorable toner which is decolorable after an image is formed. An image formed on a sheet by using decolorable toner is decolorized by heat of a predetermined temperature or higher. The sheet is, for example, paper or label paper. The sheet may be any object as long as the image forming apparatus 100 can form an image on a front surface thereof or the front surface and a rear surface thereof.

The display 110 is an image display device such as a liquid crystal display or an organic electroluminescence (EL) display. The display 110 displays various pieces of information regarding the image forming apparatus 100. The display 110 is an aspect of a display unit.

The control panel 120 has a plurality of buttons. The control panel 120 receives a user's operation. The control panel 120 outputs a signal corresponding to an operation performed by the user to a control unit (a controller) of the image forming apparatus 100. The display 110 and the control panel 120 may be formed as an integral touch panel. The control panel is an example of an input unit.

The printer 130 forms an image on a sheet on the basis of image information generated by the image reading section 200 or image information received via a communication path. The printer 130 forms an image, for example, through the following processes. An image forming unit of the printer 130 forms an electrostatic latent image on a photoconductive drum on the basis of image information. The image forming unit of the printer 130 attaches a developing agent to the electrostatic latent image so as to forma visible image. Toner is a specific example of a developing agent of some embodiments. The image forming unit (image former) of the printer 130 uses the type of toner corresponding to a designated toner mode. A transfer unit of the printer 130 transfers the formed visible image onto a sheet. A fixing unit (fixer) of the printer 130 performs heating and pressing on the sheet so as to fix the visible image onto the sheet. The sheet on which an image is formed may be a sheet accommodated in the sheet accommodation section 140, and may be a sheet which is manually fed.

In a case of performing duplex printing of forming images on both sides of a front surface and a rear surface of a sheet, the printer 130 forms an image on one surface, and then forms an image on the other surface. Hereinafter, of a front surface and a rear surface, typically, a surface on which an image is first formed is referred to as a first surface, and a surface on which an image is formed following the first surface is referred to as a second surface. Hereinafter, as an example, a description will be made of a case where the first surface is a rear surface, and the second surface is a front surface. The first surface may be a front surface, and the second surface may be a rear surface.

The sheet accommodation section 140 accommodates a sheet used to form an image in the printer 130. A sheet on which an image is formed by the printer 130 is discharged to the finisher 150.

The image reading section (image reader) 200 reads image information of a reading target with respect to the brightness and darkness of light. The image reading section 200 records the read image information. The recorded image information may be transmitted to other information processing apparatus via a network. The recorded image information may be formed as an image on a sheet by the printer 130.

Figure 2:
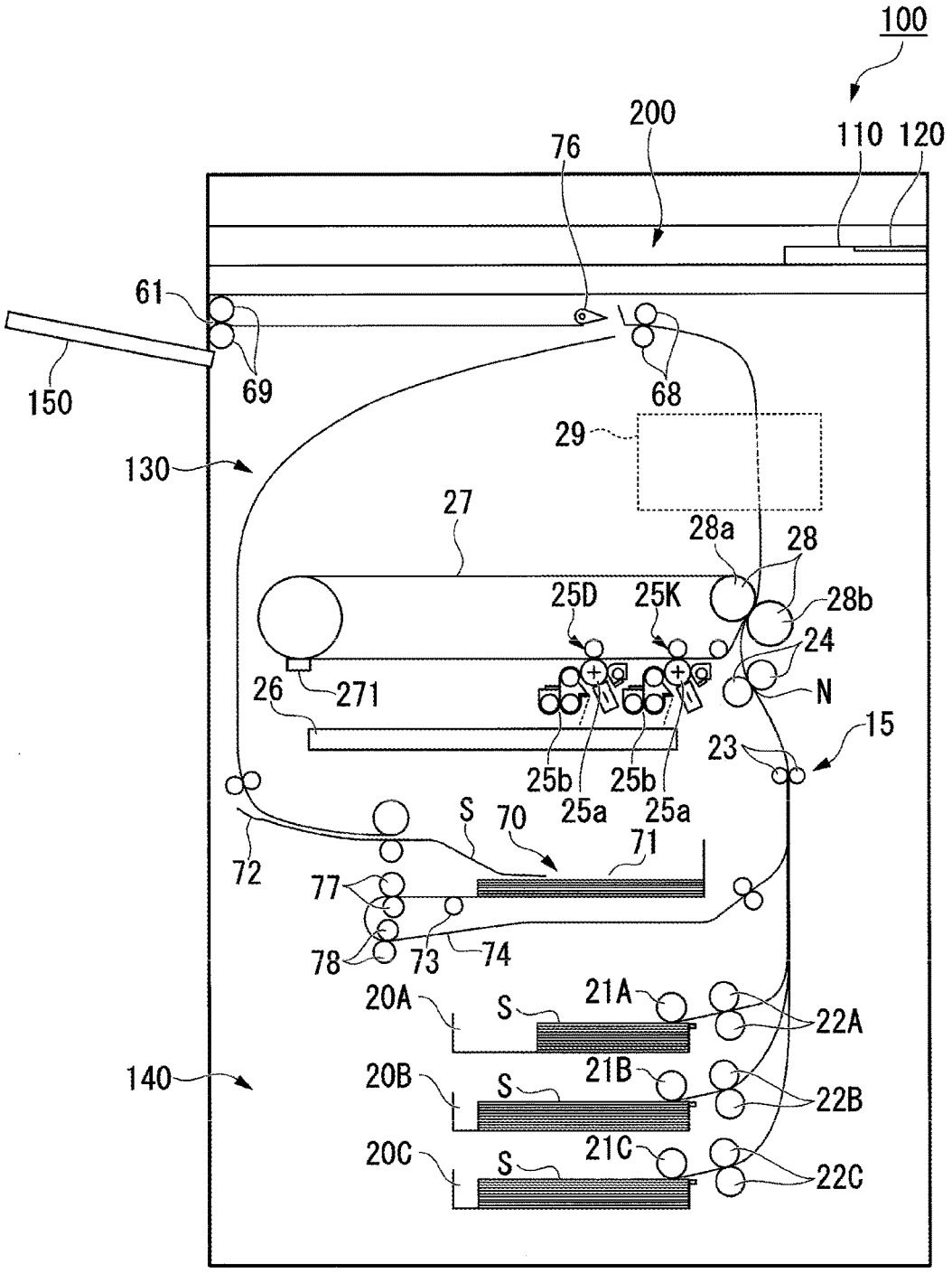
FIG. 2 is a diagram illustrating a configuration example of a printer.

FIG. 2 is a diagram illustrating a configuration example of the printer 130. The sheet accommodation section 140 includes a plurality of paper feeding cassettes 20A, 20B and 20C. The respective paper feeding cassettes 20A, 20B and 20C store sheets (S) with preset sizes and of preset types. The paper feeding cassettes 20A, 20B and 20C respectively include pickup rollers 21A, 21B and 21C. The pickup rollers 21A, 21B and 21C respectively extract sheets from the paper feeding cassettes 20A, 20B and 20C one by one. The pickup rollers 21A, 21B and 21C feed the extracted sheets to a carrying path 15.

A sheet is carried along the carrying path 15 in the printer 130 and the sheet accommodation section 140. The carrying path 15 is provided with carrying rollers 23 and resist rollers 24. A sheet fed from each of the pickup rollers 21A, 21B and 21C is carried to the resist rollers 24 along the carrying path 15. The resist rollers 24 carry a sheet according to a timing at which a transfer unit 28 of the printer 130 which will be described later transfers a toner image onto a front surface of the sheet. The carrying rollers 23 cause a leading end of the sheet in a carrying direction to abut against a nip N of the resist rollers 24. The carrying rollers 23 bend the sheet so as to adjust a position of the leading end of the sheet in the carrying direction. The resist rollers 24 align the leading end of the sheet fed from the carrying rollers 23 at the nip N and then carry the sheet to the transfer unit 28 side.

The printer 130 includes image forming units 25K and 25D, an exposure unit 26, an intermediate transfer belt 27, the transfer unit 28, and a fixing unit 29. Each of the image forming units 25K and 25D forms a toner image to be transferred onto a sheet. Each of the image forming units 25K and 25D includes a photoconductive drum 25*a*. Each of the image forming units 25K and 25D includes a development device 25*b* which selectively supplies toner to a surface of the photoconductive drum 25*a*. The development device 25*b* of the image forming unit 25K stores non-decolorable toner. The non-decolorable toner is, for example, black toner. The development device 25*b* of the image forming unit 25D stores decolorable toner. The decolorable toner is, for example, blue toner. The decolorable toner is used to form an image in the image forming unit 25D having the same configuration as that of the image forming unit 25K.

The exposure unit 26 faces the photoconductive drum 25*a* of each of the image forming units 25K and 25D. The exposure unit 26 irradiates the surface of the photoconductive drum 25*a* of each of the image forming units 25K and 25D with laser light based on image data. The exposure unit 26 forms electrostatic latent images on the surfaces of the photoconductive drums 25*a* of the image forming units 25K and 25D through irradiation with the laser light. Each development device 25*b* supplies toner to the electrostatic latent image on the surface of the photoconductive drum 25*a* so as to develop the electrostatic latent image. Each development device 25*b* forms (develops) a toner image by attaching charged toner to the electrostatic latent image on the surface of the photoconductive drum 25*a*. The development device 25*b* of the image forming unit 25K develops the electrostatic latent image on the surface of the photoconductive drum 25*a* by using the black toner. The development device 25*b* of the image forming unit 25D develops the electrostatic latent image on the surface of the photoconductive drum 25*a* by using the decolorable toner.

Each of the image forming units 25K and 25D transfers (primarily transfers) the charged toner image on the photoconductive drum 25*a* onto a surface of the intermediate transfer belt 27. Each of the image forming units 25K and 25D applies a transfer bias to the toner image on the photoconductive drum 25*a* at a primary transfer position where a primary transfer roller is in contact with the intermediate transfer belt 27. Each of the respective image forming units 25K and 25D transfers the toner image of each color on the photoconductive drum 25*a* onto the surface of the intermediate transfer belt 27 in an overlapping manner with the surface thereof. The image forming unit 25K transfers the toner image onto the surface of the intermediate transfer belt 27 in an overlapping manner with the surface thereof so as to form a non-decolorable toner image. The image forming unit 25D transfers a decolorable toner image onto the intermediate transfer belt 27.

The transfer unit 28 includes a support roller 28*a* and a secondary transfer roller 28*b* with the intermediate transfer belt 27 and a sheet interposed therebetween from both sides of a thickness direction. A position where the support roller 28*a* and the secondary transfer roller 28*b* oppose each other is a secondary transfer position. The support roller 28*a* functions as a counter electrode of the secondary transfer roller 28*b*. The transfer unit 28 applies a transfer bias corresponding to a transfer current to the secondary transfer position, so as to transfer the charged toner image on the surface of the intermediate transfer belt 27 onto a front surface of a sheet.

Residual toner on the intermediate transfer belt 27 which is not transferred onto the sheet in the transfer unit 28 is cleaned by a cleaning portion 271. For example, the cleaning portion 271 presses the tip of a blade against the intermediate transfer belt 27 to scrape off the toner on the intermediate transfer belt 27. The cleaning portion 271 may bring a charged brush into contact with the intermediate transfer belt 27.

The fixing unit 29 fixes a toner image onto a sheet at a fixing temperature in a normal operation mode (a first mode). The fixing unit 29 decolorizes decolorable toner formed on a sheet at a decolorizing temperature higher than the fixing temperature in a decolorizing mode (a second mode). Here, the decolorizing temperature is the temperature of the fixing unit 29 sufficient to decolorize decolorable toner formed on a sheet. The decolorizing temperature is a temperature higher than a temperature at which the decolorable toner is decolorized due to properties thereof, and may be defined depending on the thermal capacity of a sheet, or a sheet passing speed in the fixing unit 29. The fixing unit 29 may employ, for example, an IH (induction) heater using a phenomenon in which a heated member generates heat due to an AC magnetic field. Temperature control in the fixing unit 29 can be easily performed by using the IH heater.

A paper feeding roller pair 68 and a paper discharge roller pair 69 discharge a sheet on which an image is formed to the finisher 150 through a discharge port 61. A duplex printing device 70 is provided under the exposure unit (exposer) 26. The duplex printing device (a duplex printer) 70 reverses a sheet passed through the fixing unit 29, and sends the sheet to the carrying rollers 23 again according to a first in first out (FIFO) method. The duplex printing device 70 includes a temporary accumulation portion 71, a carrying path 72, a pickup roller 73, and paper feeding rollers 77 and 78. The temporary accumulation portion 71 temporarily accumulates (stacks) sheets. The carrying path 72 causes a sheet passed through the fixing unit 29 to branch from the carrying path 15, and guides the sheet to the temporary accumulation portion 71. The pickup roller 73 extracts sheets one by one in an order of being accumulated in the temporary accumulation portion 71. The paper feeding rollers 77 and 78 feed the extracted sheet to the carrying rollers 23 via a carrying path 74. A distribution gate 76 is provided at a branch portion between the carrying path 15 and the carrying path 72. The distribution gate 76 selectively distributes a sheet to the carrying path 15 toward the discharge port 61 or to the carrying path 72 of the duplex printing device 70.

If images are formed on both sides of a sheet, a sheet passed through the fixing unit 29 is guided to the carrying path 72 by the distribution gate 76 so as to be sequentially stacked in the temporary accumulation portion 71. The sheets temporarily accumulated in the temporary accumulation portion 71 are sequentially extracted by the pickup roller 73 from the lowermost sheet among the stacked sheets. The extracted sheet is reversed by the carrying path 74. The reversed sheet is sent to the carrying rollers 23. The sheet is positioned by the carrying rollers 23, and is then carried to the transfer unit 28 again. The transfer unit 28 transfers a toner image onto a surface of the sheet which is different from a surface on which an image is previously formed. The fixing unit 29 fixes the toner image onto the sheet at the fixing temperature. The sheet passed through the fixing unit 29 is discharged to the finisher 150 from the discharge port 61 via the paper feeding roller pair 68 and the paper discharge roller pair 69.

The printer 130 may reverse a front surface and a rear surface of a sheet of which images are formed on both sides, so as to discharge the sheet to the finisher 150. In this case, the distribution gate 76 guides the sheet of which images are formed on both sides to the carrying path 72. Consequently, the sheet is accumulated in the temporary accumulation portion 71, and is fed to the carrying rollers 23 again through the carrying path 74. The printer 130 does not form an image on the sheet of which images are formed on both sides. The sheet passed through the transfer unit 28 and the fixing unit 29 without image formation is discharged to the finisher 150 from the discharge port 61 via the paper feeding roller pair 68 and the paper discharge roller pair 69.

Figure 3:
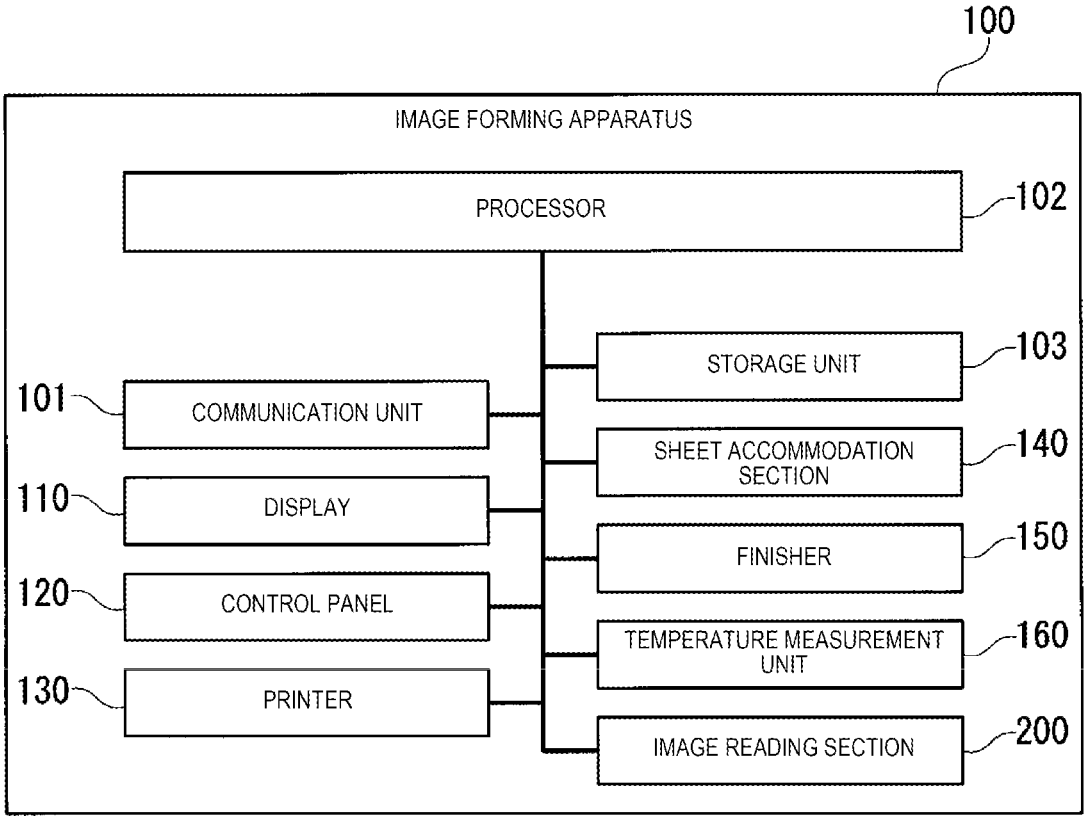
FIG. 3 is a functional block diagram of an image forming apparatus.

FIG. 3 is a functional block diagram illustrating a configuration of the image forming apparatus 100 of the exemplary embodiment. The image forming apparatus 100 includes a communication unit 101, a processor 102, a storage unit 103, the display 110, the control panel 120, the printer 130, the sheet accommodation section 140, the finisher 150, a temperature measurement unit 160, and the image reading section 200. Configurations of the display 110, the control panel 120, the printer 130, the sheet accommodation section 140, the finisher 150, and the image reading section 200 are the same as described above, and thus description thereof will be omitted.

The communication unit 101 is a network interface. The communication unit 101 performs communication with an information processing apparatus via a communication path. The information processing apparatus is, for example, a personal computer or a server.

The processor 102 is, for example, a central processing unit (CPU). If the processor 102 is a CPU, the processor 102 operates as a control unit by reading a program from a memory and executing the program. The control unit controls each unit of the image forming apparatus 100. The processor 102 receives a printing job via the communication unit 101 or the control panel 120. The printing job is job data for giving an instruction for forming an image on a sheet. The processor 102 controls each unit such that an image of the image data is formed on a sheet on the basis of the printing job.

If duplex printing in which decolorable toner is used on a first surface printed first in the duplex printing and toner is used on a second surface printed next at a fixing temperature higher than a temperature at which the decolorable toner is decolorized is set in the printing job, the processor 102 changes a printing order of an image for the first surface and an image for the second surface. If the printing order of an image for the first surface and an image for the second surface is changed, the processor 102 controls the printer 130 such that a sheet is reversed and is then discharged to the finisher 150.

The storage unit 103 is various memories such as a hard disk drive (HDD) and a DRAM. The storage unit 103 stores a program executed by the processor 102 and various pieces of data used for the processor 102 to perform processes. The temperature measurement unit 160 is a temperature sensor. The temperature measurement unit 160 measures the temperature of the fixing unit 29.

Figure 4:
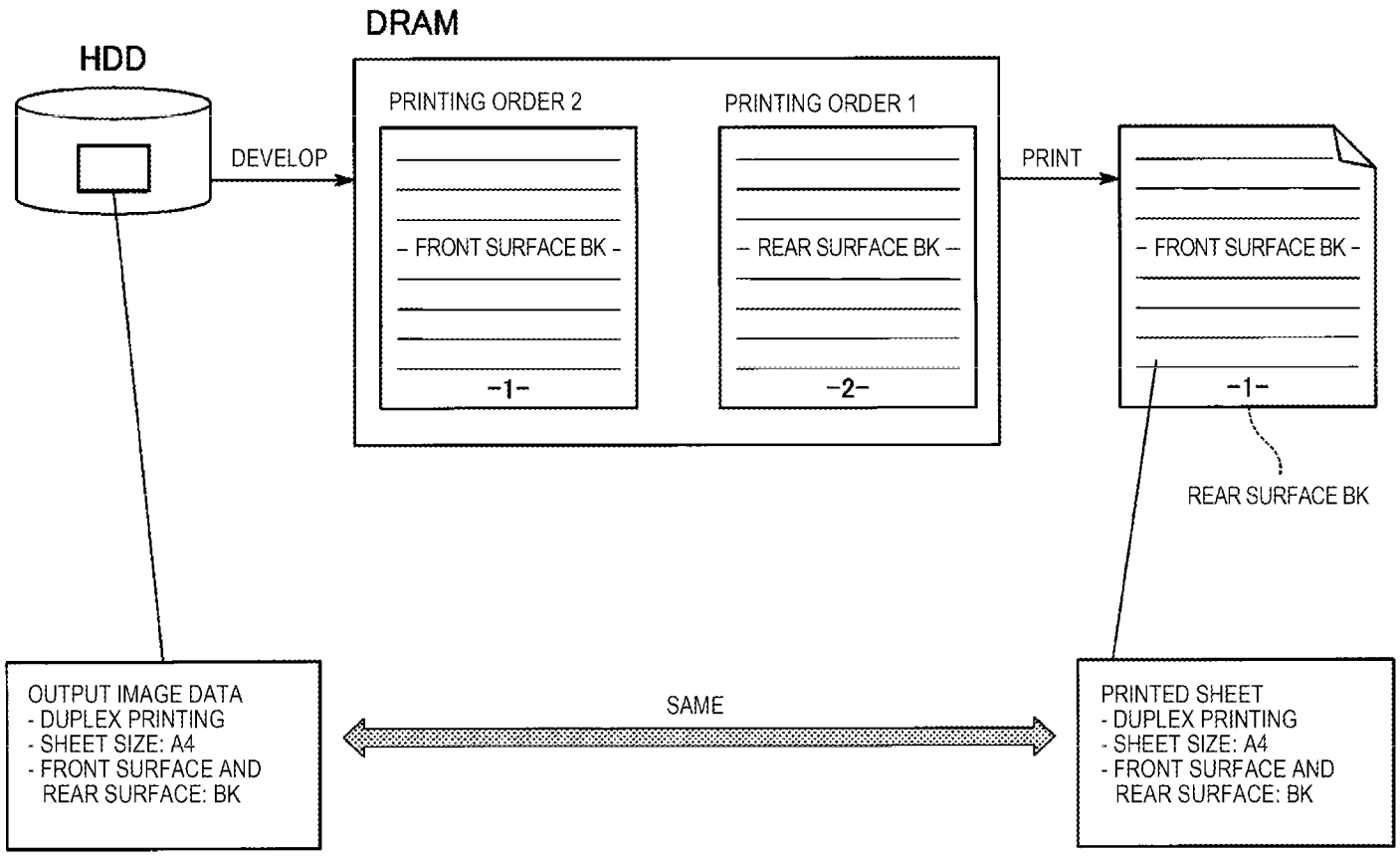
FIG. 4 is a diagram illustrating a typical duplex printing control.
Figure 5:
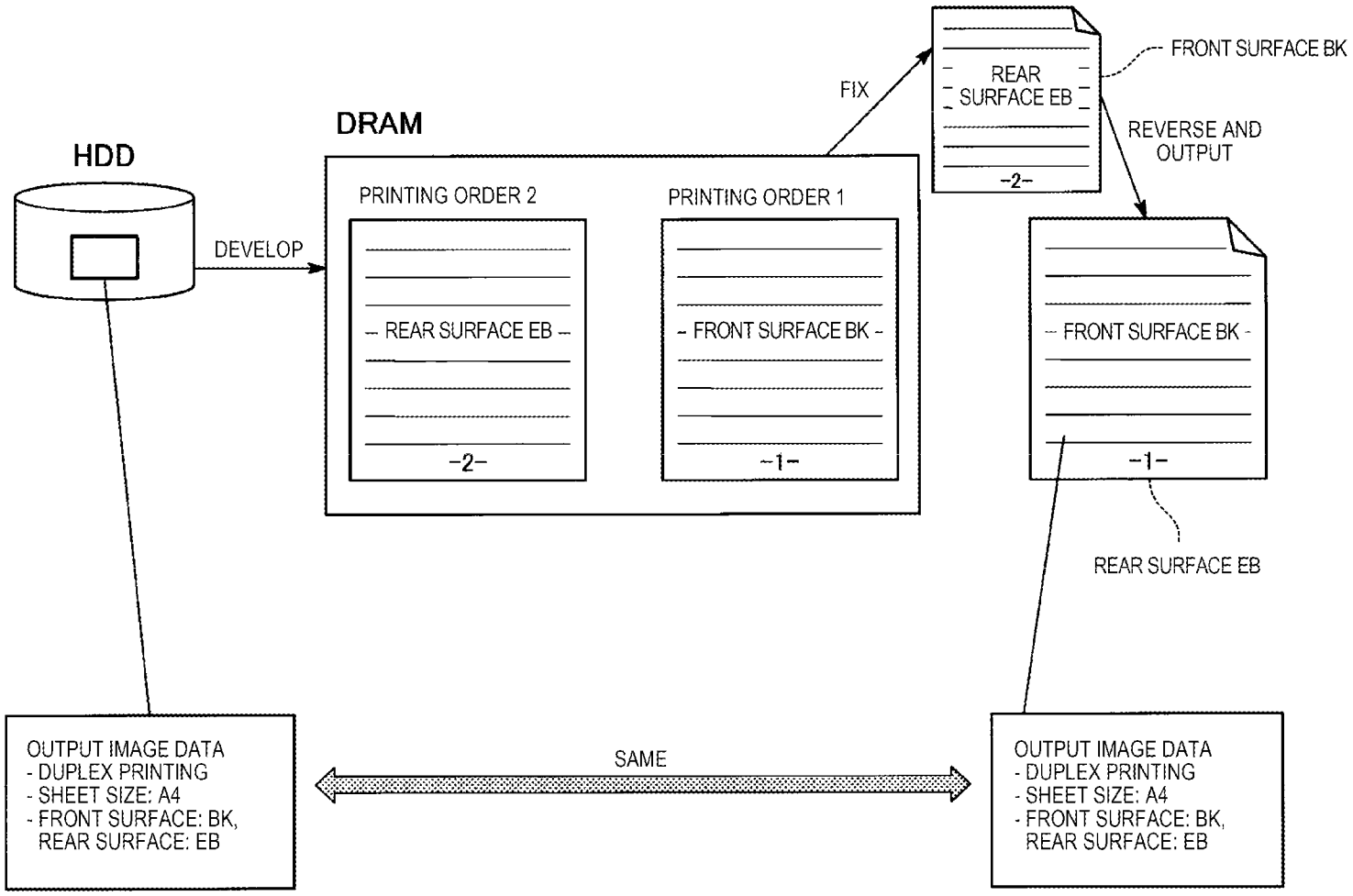
FIG. 5 is a diagram illustrating a duplex printing control in which printing orders are replaced with each other.

With reference to FIGS. 4 and 5, a description will be made of changing of a printing order. Hereinafter, a description will be made of a case where decolorable toner is erasable blue (hereinafter, referred to as "EB") toner, and toner having a fixing temperature higher than a decolorizing temperature of the EB is black (hereinafter, referred to as "BK") non-decolorable toner. A toner mode "BK" is a mode for designating that an image is formed by using the BK toner. Forming an image on a sheet in the toner mode "BK" is also referred to as BK printing. Similarly, a toner mode "EB" is a mode for designating that an image is formed by using the EB toner. Forming an image on a sheet in the toner mode "EB" is also referred to as EB printing. A user inputs a designated toner mode to an information processing apparatus which is a transmission source of a printing job. Alternatively, the user inputs a designated toner mode via the control panel 120.

FIG. 4 is a diagram illustrating typical duplex printing control. Typically, the processor 102 controls the printer 130 such that an image is formed on a rear surface (first surface), and then an image is formed on a front surface (second surface). The processor 102 stores a printing job in a hard disk drive (HDD). The printing job includes output image data. Duplex printing, a sheet size "A4", and the toner mode "BK" for a front surface and a rear surface are set in the output image data illustrated in FIG. 4. The processor 102 generates developed data in which the output image data stored in the HDD is developed, and writes the developed data to the DRAM. The developed data indicates an output image for each surface of a sheet corresponding to the printing order. A printing order 1 relates to an output image formed on a rear surface in BK printing, and a printing order 2 relates to an output image formed on a front surface in BK printing.

The processor 102 controls the printer 130 such that BK printing of the output image for the rear surface is performed on one surface of an A4 sheet through processes such as charging, exposure, development, transfer, and fixing by using the developed data written to the DRAM. The processor 102 controls the printer 130 such that BK printing of the output image for the front surface is performed on a surface which is different from the surface on which BK printing of the output image for the rear surface is performed through the same processes. The processor 102 discharges the sheet of which the images are formed on both sides to the finisher 150. A printed result on the sheet is the same as that indicated by the output image data stored in the HDD.

If duplex printing is performed on a plurality of sheets, the processor 102 may perform duplex printing on the sheets one by one. The processor 102 may form an image for the first surface on all of the plurality of sheets and then form an image for the second surface on the plurality of sheets.

If duplex printing is performed on sheets one by one, the processor 102 extracts a single sheet from the sheet accommodation section 140. The processor 102 controls the printer 130 such that BK printing of an image for the first surface is performed on the extracted sheet, and the sheet passed through the fixing unit 29 is sent to the carrying path 72 so as to be held in the temporary accumulation portion 71. The processor 102 controls the printer 130 such that the sheet held in the temporary accumulation portion 71 is extracted to undergo BK printing of an image for the second surface, and the sheet passed through the fixing unit 29 is discharged to the finisher 150. The processor 102 extracts the next printing target sheet from the sheet accommodation section 140, and repeatedly performs the same operation.

If an image for the first surface is first formed on all of a plurality of sheets, the processor 102 controls the printer 130 such that BK printing of an image for the first surface is performed on each of the plurality of sheets, and the sheets passed through the fixing unit 29 are sent to the carrying path 72 so as to be accumulated in the temporary accumulation portion 71. The processor 102 controls the printer 130 such that the sheets accumulated in the temporary accumulation portion 71 are extracted one by one to undergo BK printing of an image for the second surface, and the sheets passed through the fixing unit 29 are discharged to the finisher 150.

Also in a case of the toner mode "EB" for a front surface and the toner mode "BK" for a rear surface or in a case of the toner mode "EB" for both sides, the processor 102 operates in the same manner as in a case of the toner mode "BK" for both sides. However, in a case of the toner mode "EB" for a front surface and the toner mode "BK" for a rear surface, the processor 102 performs the following operation. In other words, the processor 102 controls the printer 130 such that the temperature of the fixing unit 29 measured by the temperature measurement unit 160 is determined as being equal to or lower than the decolorizing temperature of the EB toner, and then a sheet held in the temporary accumulation portion 71 is extracted to undergo EB printing of an image for the second surface. If simplex printing is performed, the processor 102 discharges a sheet of which an image is formed on one surface and which passed through the fixing unit 29, to the finisher 150.

FIG. 5 is a diagram illustrating duplex printing control in which printing orders are replaced with each other. The processor 102 stores a printing job in the HDD. Duplex printing, a sheet size "A4", and the toner mode "BK" for a front surface and the toner mode "EB" for a rear surface are set in output image data included in the printing job. If EB printing of an image for a rear surface is performed on an "A4" sheet, and then BK printing of an image for a front surface is performed, without replacing printing orders of the front surface and the rear surface, the image formed on the rear surface through the EB printing disappears during fixing in the BK printing. As a result, the rear surface of the sheet is output white, and this result is not expected by a user.

Therefore, if the processor 102 detects that a rear surface which is the first surface is in the EB mode and a front surface which is the second surface is in the BK mode, the processor 102 replaces printing orders of an image for the front surface and an image for the rear surface in duplex printing with each other. In other words, in developed data generated by the processor 102, the printing order 1 relates to an output image formed on the front surface in BK printing, and the printing order 2 relates to an output image formed on the rear surface in EB printing. The processor 102 controls the printer 130 such that BK printing of the output image for the front surface is performed on one surface of an A4 sheet through processes such as charging, exposure, development, transfer, and fixing by using the developed data. The processor 102 controls the printer 130 such that EB printing of the output image for the rear surface is performed on a surface which is different from the surface on which BK printing of the output image for the front surface is performed through the same processes. The processor 102 prints images on both sides by changing the printing orders, reverses the sheet, and discharges the sheet to the finisher 150. Consequently, images can be formed on a sheet as expected by the user.

If duplex printing is performed on sheets one by one, the processor 102 extracts a single sheet from the sheet accommodation section 140. The processor 102 controls the printer 130 such that BK printing of an image for the second surface is performed on the extracted sheet, and the sheet passed through the fixing unit 29 is sent to the carrying path 72 so as to be held in the temporary accumulation portion 71. If the processor 102 determines that the temperature of the fixing unit 29 measured by the temperature measurement unit 160 is equal to or lower than the decolorizing temperature of the EB toner, the processor 102 controls the printer 130 such that the sheet held in the temporary accumulation portion 71 is extracted to undergo EB printing of an image for the first surface. The processor 102 controls the printer 130 such that the sheet of which the images are formed on both sides is sent to the carrying path 72 again, the front and rear sides of the sheet are reversed, and then the sheet is carried to the carrying path 15, and is discharged to the finisher 150 without image formation. The processor 102 extracts the next printing target sheet from the sheet accommodation section 140, and repeatedly performs the same operation.

If an image for the second surface is first formed on all of a plurality of sheets, the processor 102 controls the printer 130 such that BK printing of an image for the second surface is performed on each of the plurality of sheets, and the sheets passed through the fixing unit 29 are sent to the carrying path 72 so as to be accumulated in the temporary accumulation portion 71. If the processor 102 determines that the temperature of the fixing unit 29 measured by the temperature measurement unit 160 is equal to or lower than the decolorizing temperature of the EB toner, the processor 102 controls the printer 130 such that the sheets accumulated in the temporary accumulation portion 71 are extracted one by one, and EB printing of an image for the first surface is performed on a surface which is different from the surface on which the image for the second surface is formed. The processor 102 sends the sheets of which the images are formed on both sides to the carrying path 72 again, and accumulates the sheets in the temporary accumulation portion 71. The images are formed on both sides of the plurality of sheets, and then the processor 102 controls the printer 130 such that the sheets accumulated in the temporary accumulation portion 71 are extracted one by one to be carried to the carrying path 15, and are discharged to the finisher 150 without image formation.

Figure 6:
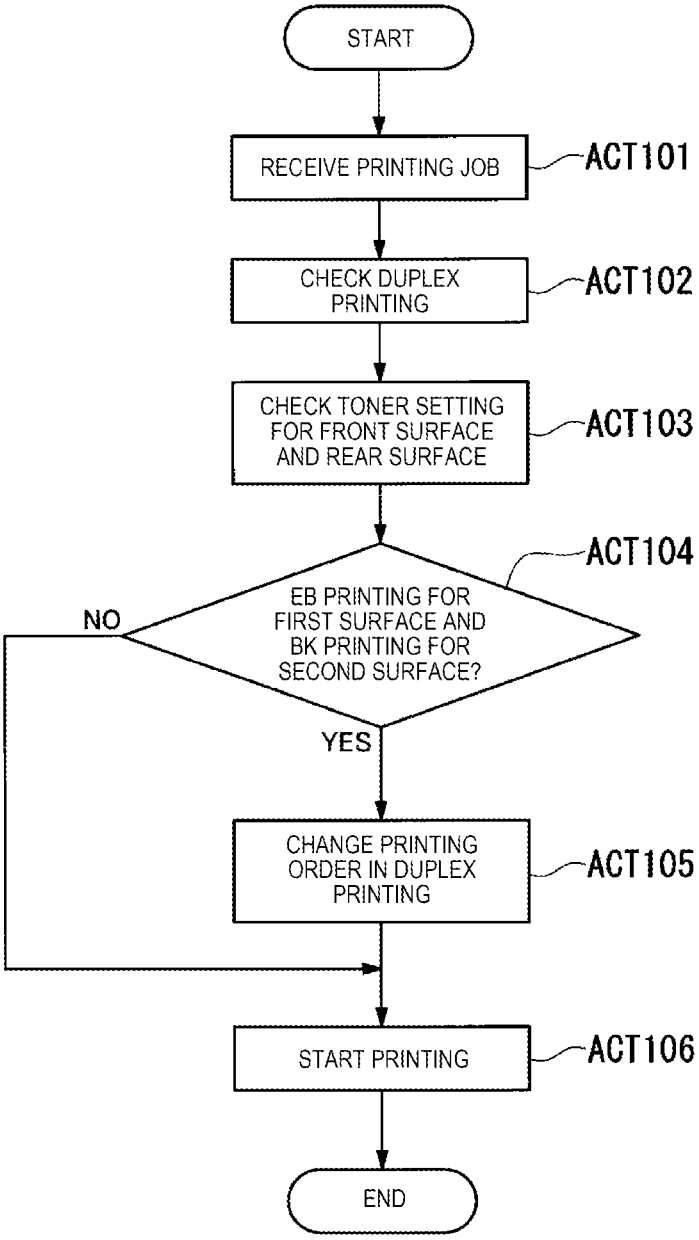
FIG. 6 is a flowchart illustrating an operation example of an image forming apparatus.

FIG. 6 is a flowchart illustrating an operation example of the processor 102 of the present exemplary embodiment. The processor 102 receives a printing job (ACT 101). The processor 102 checks an instruction for duplex printing set in the printing job (ACT 102). The processor 102 checks toner setting for each of a front surface and a rear surface set in the instruction for duplex printing (ACT 103). The processor 102 determines whether or not the printing job is a printing job in which a first surface in the duplex printing is set to undergo EB printing, and a second surface is set to undergo BK printing on the basis of a check result in ACT 102 and a check result in ACT 103 (ACT 104).

If the processor 102 determines that the printing job is a printing job in which a first surface in the duplex printing is set to undergo EB printing, and a second surface is set to undergo BK printing (ACT 104: YES), the processor 102 changes a printing order in the duplex printing (ACT 105). In other words, the processor 102 develops output image data on the DRAM such that BK printing of an image for the second surface is performed, and then EB printing of an image for the first surface is performed by referring to the printing job stored in the HDD. The processor 102 starts the duplex printing (ACT 106). The processor 102 controls the printer 130 such that images are formed on both sides of a sheet on the basis of the output image data developed on the DRAM.

If the processor 102 determines that the printing job is not a printing job in which a first surface in the duplex printing is set to undergo EB printing, and a second surface is set to undergo BK printing (ACT 104: NO), the processor 102 does not change a printing order. The processor 102 develops output image data on the DRAM and starts printing as usual (ACT 106).

Figure 7:
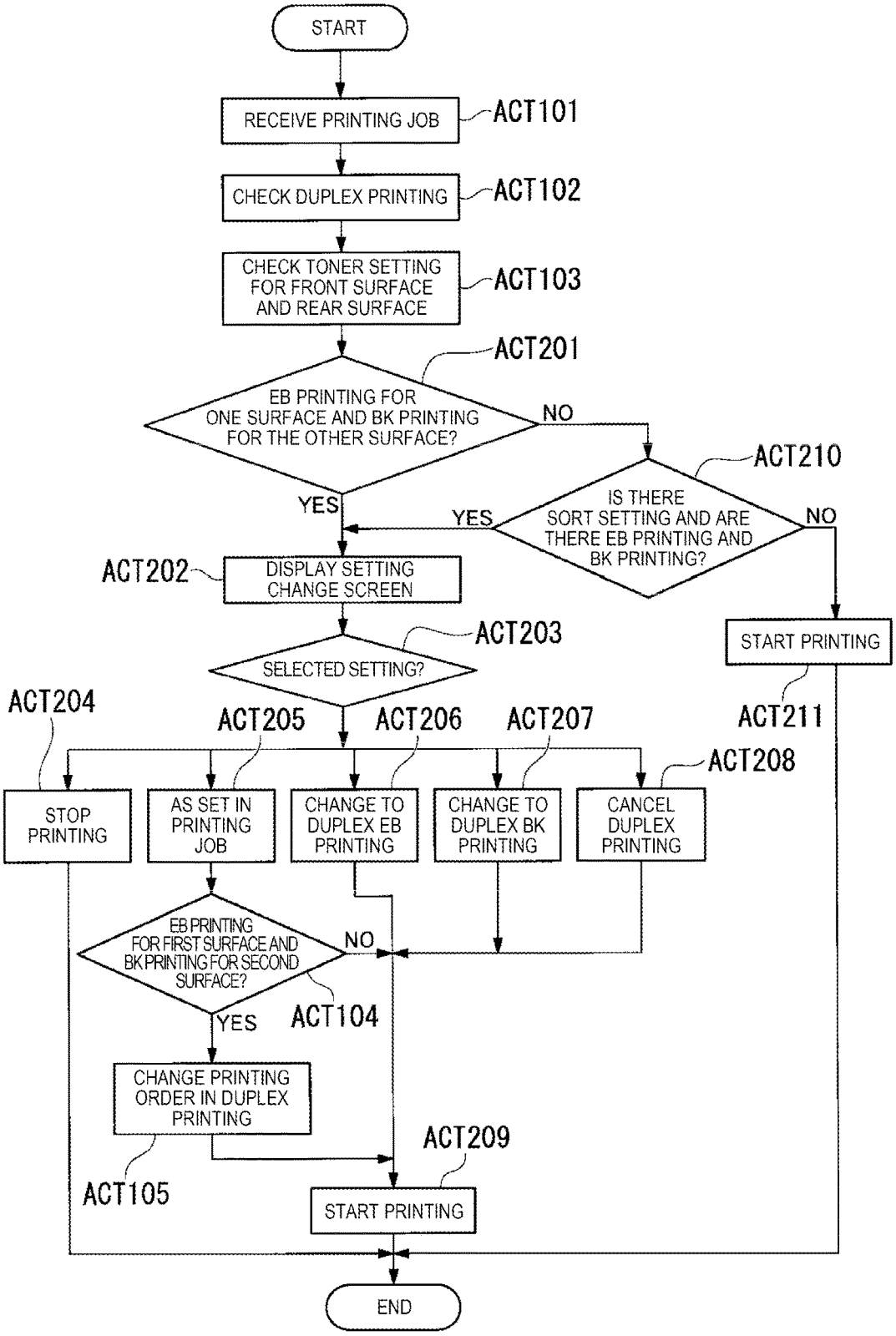
FIG. 7 is a flowchart illustrating an operation example of an image forming apparatus.

In duplex printing, time may be taken until the temperature of the fixing unit 29 is reduced to the decolorizing temperature or lower of the EB toner after BK printing is first performed on one surface. Therefore, if, in the printing job, BK printing is set to be performed on one surface in duplex printing, and EB printing is set to be performed on other surface, whether or not printing is to be performed in the set mode may be checked by a user. FIG. 7 illustrates an operation example in which the user performs checking.

FIG. 7 is a flowchart illustrating an operation example of the processor 102 of the present exemplary embodiment. The processes from ACT 101 to ACT 103 are the same as those in the operation illustrated in FIG. 6. The processor 102 determines whether or not EB printing is set to be performed on one surface in duplex printing, and BK printing is set to be performed on the other surface, on the basis of a check result in ACT 102 and a check result in ACT 103 (ACT 201). If the processor 102 determines that the printing job is a printing job in which EB printing is performed on one surface in duplex printing, and BK printing is performed on the other surface (ACT 201: YES), the processor 102 displays a setting change screen on a display of an information processing apparatus which is a transmission source of the job or the display 110 of the image forming apparatus 100 (ACT 202). The setting change screen is a screen on which the user can select any one of printing stoppage, printing as set in the printing job, printing using duplex BK, printing using duplex EB, and cancellation of duplex printing. The setting change screen may include a message indicating that time may be taken for printing as set in the printing job. The processor 102 determines a corresponding selection for which the user's instruction received from the information processing apparatus or an instruction which is input by the user via the control panel 120 is given (ACT 203).

If the processor 102 determines that printing stoppage is selected, the processor 102 stops printing, and discards the printing job (ACT 204). If the processor 102 determines that printing as set in the printing job is selected (ACT 205), the processor 102 performs the same processes as the processes in ACT 104 and ACT 105 in FIG. 6. In other words, if the processor 102 determines that the printing job is a printing job in which a first surface in the duplex printing is set to undergo EB printing, and a second surface is set to undergo BK printing (ACT 104: YES), the processor 102 changes a printing order in the duplex printing (ACT 105), and starts duplex printing (ACT 209). On the other hand, if the processor 102 determines that the printing job is not a printing job in which a first surface in the duplex printing is set to undergo EB printing, and a second surface is set to undergo BK printing (ACT 104: NO), the processor 102 does not change a printing order, and starts duplex printing (ACT 209).

If the processor 102 determines that duplex EB printing is selected, the processor 102 changes a toner mode set in the printing job to EB for both sides (ACT 206), and starts printing without changing a printing order (ACT 209). If the processor 102 determines that duplex BK printing is selected, the processor 102 changes a toner mode set in the printing job to BK for both sides (ACT 207), and starts printing without changing a printing order (ACT 209). If the processor 102 determines that cancellation of duplex printing is input, the processor 102 cancels duplex printing in the printing job, and changes duplex printing to simplex printing (ACT 208), and starts printing (ACT 209).

If the processor 102 determines that the printing job is not a printing job in which EB printing is performed on one surface in duplex printing, and BK printing is performed on the other surface (ACT 201: NO), the processor 102 performs the process in ACT 210. The processor 102 determines whether or not the printing job is a printing job in which sorting is set, and EB printing and BK printing are set (ACT 210). Setting of sort includes magazine sort and saddle stitch. If the processor 102 determines whether or not the printing job is not a printing job in which sorting is set, and EB printing and BK printing are set (ACT 210: NO), the processor 102 starts printing according to the printing job (ACT 211). If the processor 102 determines whether or not the printing job is a printing job in which sorting is set, and EB printing and BK printing are set (ACT 210: YES), the processor 102 performs printing from ACT 202.

Image formation on sheets in the image forming apparatus 100 is performed from a first page of the first surface in an ascending order. A case is assumed in which duplex printing of four pages is set in one job, and BK printing is set for the first page and EB printing is set for the second to fourth pages. In this case, the processor 102 forms and fixes a BK image (a first page in the printing job) for the second surface on and to a surface of a sheet, and then forms and fixes an EB image (a second page in the printing job) for the first surface on and to a surface which is different from the surface on which the image for the second surface is formed. Therefore, the EB image on the rear surface of the first sheet can be prevented from disappearing.

In the exemplary embodiment, a case where only one type of non-decolorable toner is used was described as an example, but a plurality of types of non-decolorable toner may be used. In this case, the printer 130 includes the image forming unit 25K accommodating each type of non-decolorable toner. In ACT 104, the processor 102 may determine whether or not the printing job is a printing job for duplex printing in which decolorable toner is used on the first surface, and non-decolorable toner having a fixing temperature higher than a decolorizing temperature of the decolorable toner is used on the second surface.

According to the exemplary embodiment, if a printing job for duplex printing in which decolorable toner is set to be used on an initial printing surface of a sheet, and non-decolorable toner is set to be used on the next printing surface of the sheet is received, the image forming apparatus 100 replaces an order of forming an image on a front surface with an order of forming an image on a rear surface. Alternatively, the image forming apparatus 100 may stop printing, cancel duplex printing, and change toner to be used on the basis of a user's instruction for the printing job. If, in a printing job, decolorable toner is set to be used on the first surface, and non-decolorable toner having a fixing temperature lower than a decolorizing temperature of the decolorable toner is set to be used on the second surface, the image forming apparatus 100 may perform duplex printing in which an image for the first surface is formed, and then an image for the second surface is formed, as usual.

According to at least one example embodiment described above, if duplex printing in which decolorable toner is used on the first surface which is a surface on which an image is first formed of a front surface and a rear surface of a sheet, and toner having a fixing temperature higher than a decolorizing temperature of the decolorable toner is used on the second surface which is a surface on which an image is formed after the first surface, is set in job data for giving an instruction for image formation, the processor 102 can control the printer 130 to form an image for the second surface on a sheet, then to reverse the sheet, and to form an image for the first surface on a surface which is different from a surface on which the image for the second surface is formed. Therefore, an image formed on one surface in duplex printing by using decolorable toner can be prevented from being decolorized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a printer configured to transfer a visible image formed by attaching toner to an electrostatic latent image on a photoconductive drum onto a sheet, to heat and press the sheet onto which the visible image is transferred so as to fix the visible image onto the sheet, and to thereby form an image on the sheet; and a controller configured to control the printer to form an image for a second surface on a sheet, and then to form an image for a first surface on a surface which is different from a surface on which the image for the second surface is formed, when the controller determines that duplex printing is set according to job data to provide an instruction for image formation, wherein, in the duplex printing, decolorable toner is applied on the first surface which is a surface on which an image is first formed, of a front surface and a rear surface of a sheet, and toner having a fixing temperature higher than a decolorizing temperature of the decolorable toner is applied on the second surface, which is a surface on which an image is formed after the first surface.

2. The image forming apparatus according to claim 1, wherein, when the image for the second surface is formed on the sheet, and then the image for the first surface is formed, the controller is configured to control the printer to reverse the sheet and then to discharge the sheet.

3. The image forming apparatus according to claim 1, wherein, when the controller determines that duplex printing in which decolorable toner is applied on first surfaces of a plurality of sheets, and toner having the fixing temperature higher than the fixing temperature of the decolorable toner is applied on second surfaces of the sheets, is set in the job data, the controller is configured to control the printer to form an image for the second surface on the plurality of sheets and then to form an image for the first surface on surfaces which are different from surfaces on which the image for the second surface is formed with respect to the plurality of sheets.

4. The image forming apparatus according to claim 1, wherein the printer is configured to form the image for the second surface on the sheet, and then the controller is configured to control the printer to form the image for the first surface on the sheet after the temperature of a fixing portion configured to heat and press the sheet in the printer is detected as being equal to or lower than the decolorizing temperature of the decolorable toner.

5. The image forming apparatus according to claim 1, wherein the controller is configured to cause a display to show a setting change screen when the controller determines that duplex printing in which decolorable toner is applied on one surface of a sheet and toner having the fixing temperature higher than the decolorizing temperature of the decolorable toner is applied on the other surface of the sheet is set in the job data, and perform any of a process of stopping image formation, a process of controlling the printer to form an image by applying the decolorable toner on both sides of the sheet, a process of controlling the printer to form an image by applying non-decolorable toner on both sides of the sheet, or a process of controlling the printer to form an image on the sheet by canceling duplex printing, on the basis of an instruction which is inputted according to the display on the setting change screen.

6. The image forming apparatus according to claim 1, wherein when the controller determines that the instruction is for duplex printing in which the decolorable toner is set to be applied to the first surface and the toner having the fixing temperature higher than the decolorizing temperature is set to be applied to the second surface, the controller is configured to change a printing order of one or more sheets to be printed, and then start duplex printing.

7. The image forming apparatus according to claim 2, wherein the controller is configured to control the printer to reverse the sheet and then discharge the sheet after causing a change of a printing order corresponding to an order in which sheet surfaces are printed on.

8. The image forming apparatus according to claim 4, wherein the controller is configured to temporarily hold a sheet to be printed with the decolorable toner until the temperature of the fixing portion is detected as being equal to or lower than the decolorizing temperature.

9. An image forming method comprising:

transferring, by a printer, a visible image formed by attaching toner to an electrostatic latent image on a photoconductive drum onto a sheet, and fixing the visible image onto the sheet to thereby form an image on the sheet; and upon determining that duplex printing is set according to job data to provide an instruction for image formation, controlling, by a controller, the printer to form an image for a second surface on a sheet, and then to form an image for a first surface on a surface which is different from a surface on which the image for the second surface is formed, wherein, in the duplex printing, decolorable toner is applied on the first surface which is a surface on which an image is first formed of a front surface and a rear surface of a sheet, and toner having a fixing temperature higher than a decolorizing temperature of the decolorable toner is applied on the second surface, which is a surface on which an image is formed after the first surface.

10. The image forming method according to claim 9, further comprising controlling the printer to reverse the sheet and then to discharge the sheet after the image for the second surface is formed and the image for the first surface is formed.

11. The image forming method according to claim 9, further comprising, upon determining that the job data includes a setting for duplex printing in which decolorable toner is applied on first surfaces of a plurality of sheets, and toner having a fixing temperature higher than a fixing temperature of the decolorable toner is applied on second surfaces of the sheets, controlling the printer to form an image for the second surface on the plurality of sheets and then to form an image for the first surface on surfaces which are different from surfaces on which the image for the second surface is formed with respect to the plurality of sheets.

12. The image forming method according to claim 9, further comprising:

causing the printer to form the image for the second surface on the sheet, and controlling, by the controller, the printer to form the image for the first surface on the sheet after the temperature of a fixing portion configured to heat and press the sheet in the printer is detected as being equal to or lower than the decolorizing temperature of the decolorable toner.

13. The image forming method according to claim 9, further comprising:

displaying a setting change screen upon determining that duplex printing in which decolorable toner is applied on one surface of a sheet and toner having the fixing temperature higher than the decolorizing temperature of the decolorable toner is applied on the other surface of the sheet is set according to the job data, and performing any of a process of stopping image formation, a process of controlling the printer to form an image by applying the decolorable toner on both sides of the sheet, a process of controlling the printer to form an image by applying non-decolorable toner on both sides of the sheet, or a process of controlling the printer to form an image on the sheet by canceling duplex printing, on the basis of an instruction which is inputted according to a display of the setting change screen.

14. The image forming method according to claim 9, further comprising:

determining that the instruction is for duplex printing in which the decolorable toner is set to be applied to the first surface and the toner having the fixing temperature higher than the decolorizing temperature is set to be applied to the second surface, and thereafter, changing a printing order of one or more sheet surfaces to be printed, and starting duplex printing.

15. The image forming method according to claim 10, further comprising controlling the printer to reverse the sheet and then discharge the sheet after causing a change of a printing order corresponding to an order in which one or more sheet surfaces undergo printing.

16. The image forming method according to claim 12, further comprising temporarily holding a sheet to be printed with the decolorable toner until the temperature of the fixing portion is detected as being equal to or lower than the decolorizing temperature.

* * * * *